US007469894B2

(12) United States Patent
Seto

(10) Patent No.: US 7,469,894 B2
(45) Date of Patent: Dec. 30, 2008

(54) IMAGE FORMING APPARATUS

(75) Inventor: Masaki Seto, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 450 days.

(21) Appl. No.: 11/339,787

(22) Filed: Jan. 26, 2006

(65) Prior Publication Data

US 2006/0170149 A1 Aug. 3, 2006

(30) Foreign Application Priority Data

Jan. 31, 2005 (JP) ..... 2005-022721

(51) Int. Cl.
*B65H 9/00* (2006.01)

(52) U.S. Cl. ..... 271/238; 271/240; 271/251; 271/252; 271/254

(58) Field of Classification Search ..... 271/234, 271/238, 240, 248, 250, 251, 252, 253, 254; 399/389, 394, 395
See application file for complete search history.

(56) References Cited

U.S. PATENT DOCUMENTS 4,334,759 A * 6/1982 Clausing ..... 399/394
5,937,260 A * 8/1999 Taninaka et al. ..... 399/401

FOREIGN PATENT DOCUMENTS

| | | |
|---|---|---|
| JP | 57-4844 | 1/1982 |
| JP | 62-186848 | 11/1987 |
| JP | 1-53886 | 3/1989 |
| JP | 1-53889 | 3/1989 |
| JP | 11-189355 | 7/1999 |
| JP | 2000-355447 | 12/2000 |

* cited by examiner

*Primary Examiner*—David H Bollinger
(74) *Attorney, Agent, or Firm*—Fitzpatrick, Cella, Harper & Scinto

(57) ABSTRACT

An image forming apparatus which conveys a sheet to a nip portion between an intermediate transfer belt and a secondary transfer out-roller to record an image includes a sheet conveying device which conveys the sheet to the nip portion, a CCD line sensor which detects a sheet size in a sheet width direction perpendicular to a conveyance direction of the sheet, and a transfer-side regulating device which is arranged near the nip portion and regulates the width direction of the conveyed sheet. The transfer-side regulating device can move the nip portion to a position where the width direction of the conveyed sheet is regulated based on a detection result obtained by the CCD line sensor.

10 Claims, 16 Drawing Sheets

VIEW FROM ARROW A

IMAGE FORMING APPARATUS

BACKGROUND OF THE INVENTION

1. Field of the Invention

The present invention relates to an image forming apparatus which conveys a sheet to an image recording device to record an image and, more particularly, to an image forming apparatus which can suppress skew feeding of a sheet in image transferring.

2. Description of the Related Art

In an electrophotographic image forming apparatus, after a toner image is formed on an image bearing member, a transfer portion brings a sheet into contact with the image bearing member to electrically transfer the toner image onto the sheet. At this time, a method using a transfer roller which transfers the image while bringing the sheet in stable contact with the image bearing member and also stably conveys the sheet is popularly used.

In a conventional electrophotographic image forming apparatus, in order to improve the printing accuracy of a toner image on a sheet, the following configuration is employed.

A first conventional image forming apparatus is shown in FIG. 8. This image forming apparatus 100 feeds a sheet P supported on a sheet stacking portion 120 with a feed roller 124. The fed sheet P is fed to a stopped registration roller pair 123 through a conveyance roller pair 122. The distal end of the sheet P is brought into contact with a registration roller pair 123 and further pushed into the registration roller pair 123 to form a loop, and the skew of the distal end is corrected to perform alignment (see FIGS. 9A and 9B). Thereafter, the registration roller pair 123 is rotated to convey the sheet P to the transfer portion. The transfer portion transfers the toner image from a transfer belt (an image bearing member) 131 serving as an image bearing member while being conveyed by both the registration roller pair 123 and the transfer roller 135. The sheet P transferred onto the toner image is transferred is conveyed to a fixing device 144 by the drive of the transfer roller 135.

Therefore, the sheet P is subjected to a process of sheet alignment correction by the registration roller pair 123, printing accuracy such as a distal-end registration roller accuracy and a perpendicularity are preferably obtained when the toner image is transferred. As a reference in which such a configuration is disclosed, Japanese Patent Application Laid-open (JP-A) No. 1-53886 is known.

Not only correction of the distal end of the sheet by the registration roller pair 123 but also correction of a position in a sheet width direction which is perpendicular to a sheet conveyance direction can be made possible by arranging a skew roller on the upstream side of the registration roller pair 123. Such an apparatus, as shown in FIGS. 10A to 10D, a reference wall 223 is arranged on a part of a sheet guide near the skew roller 226 in parallel to the conveyance direction of the sheet. The skew roller 226 causes the sheet-side end to extend from the reference wall 223 to convey sheet along the reference wall 223 (see FIG. 10A) . Furthermore, a registration roller pair 227 which moves the sheet P to a conveyance center 228 (reference position at a center in the sheet width direction) reciprocally operates (reciprocal operation in the vertical direction in FIG. 10A). In this manner, the sheet center 229 (center of the sheet in the sheet width direction) is matched with the conveyance center 228 to convey the sheet to the transfer portion (see FIGS. 10A to 10D).

In the transfer portion, the sheet P is conveyed by both the registration roller pair 227 and a transfer roller 235, and a toner image is transferred from a image bearing member 231 onto the sheet P (see FIG. 10C). The sheet P on which the toner image is transferred is conveyed to a fixing device 244 by the transfer roller 235. At this time, in order to cause the registration roller pair 227 to perform a reciprocal operation for a next sheet P' immediately after the distal end of the sheet P is held by the nip of the transfer portion, the registration roller pair 227 performs a reciprocal operation which returns the sheet P to an original standby position in a state in which the nipping of the registration roller pair 227 is released (see FIG. 10D).

In this manner, the sheet P is subjected to a process of sheet alignment correction to preferably obtain printing accuracy such as a lateral registration (sheet width direction registration) accuracy and a perpendicularity when the toner image is transferred. As a reference in which the configuration is disclosed, JP-A No. 11-189355.

However, the above conventional technique has the following problem.

As described in JP-A No. 1-53889, in the image forming apparatus which corrects sheet alignment to an image by the registration roller pair 123, the sheet P is conveyed to the transfer portion. Thereafter, after the sheet P is removed from the nip of the registration roller pair 123, the sheet P must be solely conveyed depending on the size of the sheet P.

In this case, when the outer diameter of the transfer roller 135 is not uniform, or when the degree of parallelization to the registration roller pair 123 is low, skew feeding occurs such that the sheet P is skewed. When an image ratio of a toner image to be transferred extremely deviates from a direction perpendicular to the sheet conveyance direction, a friction coefficient between the transfer belt 131 and the sheet P deviates. More specifically, when the friction coefficient decreases, a transfer nip portion serving as a portion where the toner image ratio is high has a conveyance power lower than a portion where the image ratio is low. In this manner, the uniformity of the conveyance power skews the sheet conveyed by a single transfer roller. The skew feeding of the sheet disadvantageously deteriorates an image position accuracy to degrade image quality.

Similarly, in the image forming apparatus disclosed in JP-A No. 11-189355, even though a lateral registration accuracy of the sheet P for a toner image is secured by the skew roller 226 and the reference wall 223, the respective rollers of the registration roller pair 227 are separated from each other. For this reason, the sheet is conveyed by the single transfer roller in a state in which the nip of the sheet P is released. For this reason, the sheet is skewed.

In this manner, the image position accuracy is deteriorated to cause deterioration of image quality. In addition, in the image forming apparatus described in JP-A No. 11-189355, since the registration roller pair 227 releases their nip before the registration roller pair 227 passes through the rear end of the sheet P, a distance of conveyance singularly performed by a transfer roller becomes long to further increase an amount of skew feeding. Furthermore, in order to avoid this, a reciprocal operation to a standby position may be performed after the rear end of the sheet P passes through the registration roller pair 227. However, since a sheet conveyance interval of operation time for returning the registration roller pair 227 to the standby position must be assured, productivity is considerably deteriorated.

SUMMARY OF THE INVENTION

The present invention has been made in consideration of the above points, and has as its object to provide an image forming apparatus which prevents a sheet from being skewed in an image recording device to make it possible to record an image having high image quality.

The present invention to solve the above problem, in the image forming apparatus which conveys a sheet to an image recording device to record an image, has the following configuration: a sheet conveying device which conveys a sheet to the image recording device; a sheet width direction regulating device which is brought into contact with a side end of the sheet on which an image is formed by the image recording device which regulates a width direction of the sheet while the image is formed on the sheet; and a control unit which controls the sheet width direction regulating device to move the sheet width direction regulating device to a position where the width direction of the sheet is regulated depending on a size of the sheet on which an image is to be formed.

DESCRIPTION OF THE PREFERRED EMBODIMENT

An image forming apparatus according to an embodiment of the present invention will be described below with reference to the accompanying drawings.

{Entire Configuration of Image Forming Apparatus}

Figure 1:
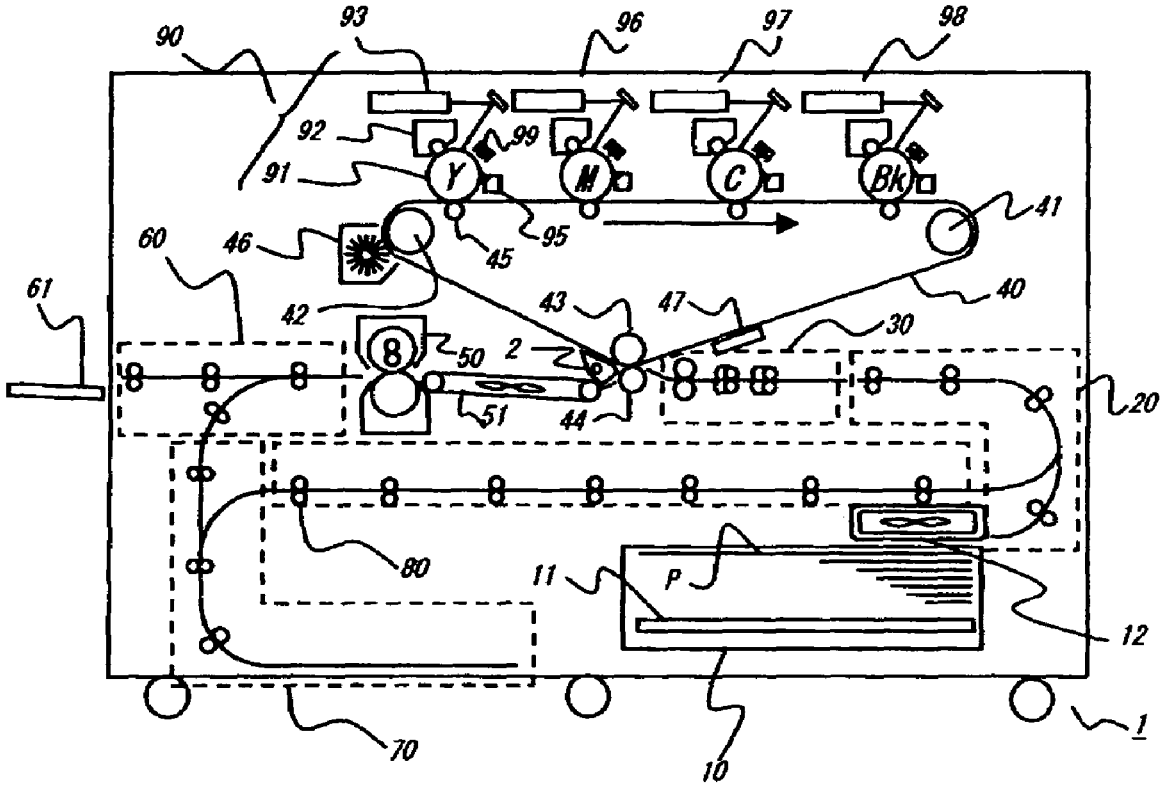
FIG. 1 is a sectional view showing a schematic configuration of an image forming apparatus of an electrophotographic type according to an embodiment of the present invention.

An entire configuration of an image forming apparatus will be described below with reference to FIG. 1. FIG. 1 is a diagram for explaining a section of a color image forming apparatus.

An image recording device is arranged on the upper portion of an apparatus main body 1. A sheet is upwardly conveyed from a feeding deck arranged at the lower portion of the apparatus main body to transfer an image formed by an image recording device by a transfer portion, and the sheet is discharged to a discharge portion.

As the image recording device, four image forming stations are arranged in almost parallel to each other. In this embodiment, a yellow station 90, a magenta station 96, a cyan station 97, and a black station 98 are arranged in this order starting from the left in FIG. 1. The stations form images with corresponding color toners by an electrophotographic type, respectively. The stations have the same configuration except for the colors of the toners. In this case, the configuration of the yellow station 90 will be briefly described as an example.

A primary charger 99, a developing device 92, and a cleaning device 95 are arranged around a photosensitive drum 91. A scanner unit 93 which irradiates a laser beam depending on an image signal is arranged above the photosensitive drum 91.

An endless intermediate transfer belt 40 serving as an image bearing member is arranged to be brought into contact with the photosensitive drum 91. The intermediate transfer belt 40 is rotatably supported by a driving roller 42, a steering roller 41 which controls deviation of the belt, and a secondary transfer roller 43 which transfers a multiple-transferred image onto a sheet. In this manner, a primary transfer roller 45 is arranged at a position opposing the photosensitive drum 91 to sandwich the intermediate transfer belt 40 between the primary transfer roller 45 and the photosensitive drum 91.

In image formation, the surface of the photosensitive drum 91 is uniformly charged by the primary charger 99, and a laser beam from the scanner unit 93 depending on an image signal is irradiated on the surface of the photosensitive drum 91 to form an electrostatic latent image. The latent image is developed with toner by the developing device 92 to obtain a visible image.

The toner image is primarily transferred onto the intermediate transfer belt 40 by applying a bias to the primary transfer roller 45. The yellow, magenta, cyan, and black toners formed by the image forming stations are superimposed on the intermediate transfer belt 40 to transfer the image, so that a color image is formed. The color image is secondarily transferred on a sheet conveyed by the sheet conveying device by applying a bias to a secondary transfer out-roller 44 in a secondary transfer portion serving as an image recording device to record the image. Toner remaining on the intermediate transfer belt 40 after the toner images are transferred onto the sheet is cleaned by a cleaning device 46.

The sheet P onto which the toner images are transferred in the secondary transfer portion is guided to a fixing device 50 by a conveyance belt 51. Heat and pressure are applied to the sheet to fix the toner images to the sheet P, and the sheet P is discharged to a discharge tray 61 by a discharge device 60. In the image forming apparatus according to the embodiment, when images are recorded on both the sides of a sheet, an inverting device 70 which inverts the sheet having one side on which an image is recorded and a re-feeding device 80 which conveys the inverted sheet to the secondary transfer portion again.

{Sheet Conveying Device}

The configuration of the sheet conveying device to convey a sheet to the secondary transfer portion serving as the image recording device.

A feeding deck 10 in which sheets P are stacked and stored is arranged on the lower portion of the apparatus main body 1 such that the feeding deck 10 can be inserted into or removed from the lower portion. The feeding deck 10 is constituted by a conveyance belt 12 having a suction fan and a sheet face detecting sensor. The sheet P sucked by the suction fan is sent to the downstream side by the conveyance belt to feed the sheet P. In this case, according to information from a sheet face detecting sensor (not shown), an elevating operation of a lifter plate 11 is continuously performed to control a sheet face position without non-feeding and double feeding. Loosing air which looses sheets in the sheet conveyance direction and a sheet width direction perpendicular to the sheet conveyance direction to further prevent sheets from being doubly fed. Thereafter, a single sheet P is sent to a sheet conveying device 20 constituted by a roller pair.

When a sheet stack is supported on the feeding deck 10 serving as a sheet stacking portion , a sheet width detecting device which detects sizes in a sheet feeding direction and a sheet width direction. More specifically, on the feeding deck 10, the sheet stack is fixed by a threshold plate at one end in the conveyance direction and both side ends of in the sheet width direction. A conveyance direction size detecting sensor (not shown) and a conveyance perpendicular direction size detecting sensor S1 which discriminate sheet sizes in the sheet conveyance direction and the sheet width direction depending on adjustment of an arrangement position of the threshold plate are arranged. The sheet sizes of the sheet stack stored in the feeding deck can be understood.

{Sheet Position Adjusting Device}

A sheet conveyed by the sheet conveying device is subjected to a position adjustment process by a registration device 30 serving as a sheet position adjusting device before a sheet conveyed by the sheet conveying device reaches the secondary transfer portion.

Figure 2:
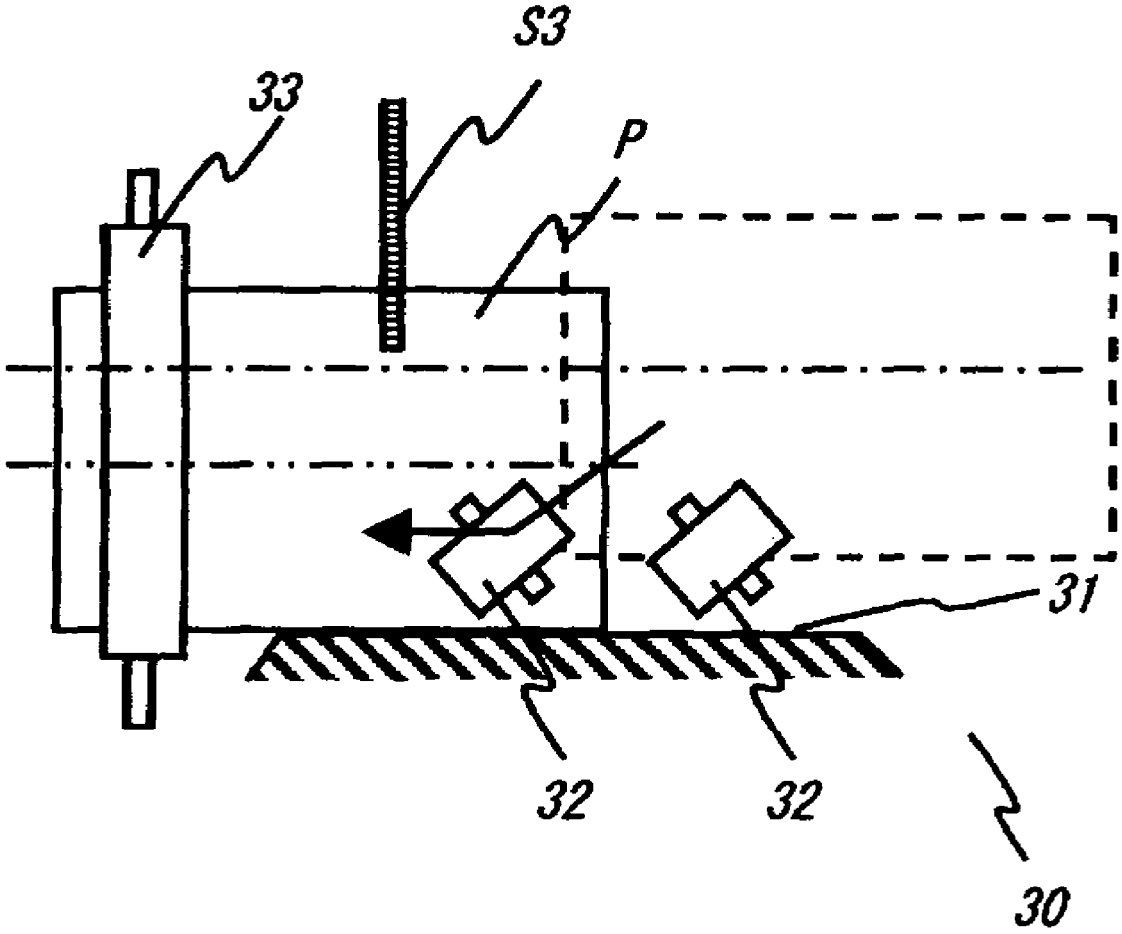
FIG. 2 is a schematic diagram of the configuration of a registration device according to the embodiment of the present invention.

In the configuration of the registration device 30, as shown in FIG. 2, the position of the sheet in the width direction and the skew of the sheet are adjusted by a sheet correcting plate 31 which can be moved depending on the lateral width of a sheet P to be conveyed and a skew feed roller 32 to bring the sheet P into contact with the sheet correcting plate 31. Furthermore, a position of the sheet in the conveyance direction is adjusted by a registration roller pair 33 to adjust alignment of the distal end of the sheet and the distal end of an image by the number of rotations of the rollers.

In adjustment of sheet conveyance timing in the conveyance direction, based on information from a patch detecting sensor 47 (see FIG. 1), a sheet feeding rate is determined. Since an operation performed by the registration roller pair 33 and the skew feed roller 32 is the same as the operation explained by using FIGS. 10A to 10D, an overlapping explanation will not be described.

As a drive system for the registration roller pair 33, a registration roller drive motor M1 (shown in FIG. 4) which is connected to the registration roller pair 33 through a coupling (not shown) to rotationally drive the registration roller pair 33 is used. In order to perform reciprocal operation of the registration roller pair 33, a registration roller reciprocal drive motor M2 (shown in FIG. 4) which transmits drive from a rack (not shown) and a pinion (not shown) is used. As drive systems for the skew feed roller 32, a skew feed roller drive motor (not shown) to rotationally drive the skew feed roller 32 and a skew roller attaching/detaching motor which performs an attaching/detaching operation of the skew feed roller through a cam (not shown).

A CCD line sensor S3 serving as a sheet width detecting device to accurately detect the length of the sheet P in the width direction at a position where sheet position adjustment in the sheet width direction is performed by the skew feed roller 32 is arranged. The CCD line sensor S3 detects the position of the other side end of a sheet, one side end of which is brought into contact with the sheet correcting plate 31, to read a relative distance from the sheet correcting plate 31 by estimation based on pixels of the CCD to detect a sheet width. For this reason, variable lengths of the sheets P in the width direction can be accurately recognized one by one.

{Sheet Width Direction Regulating Device}

Figure 3A:
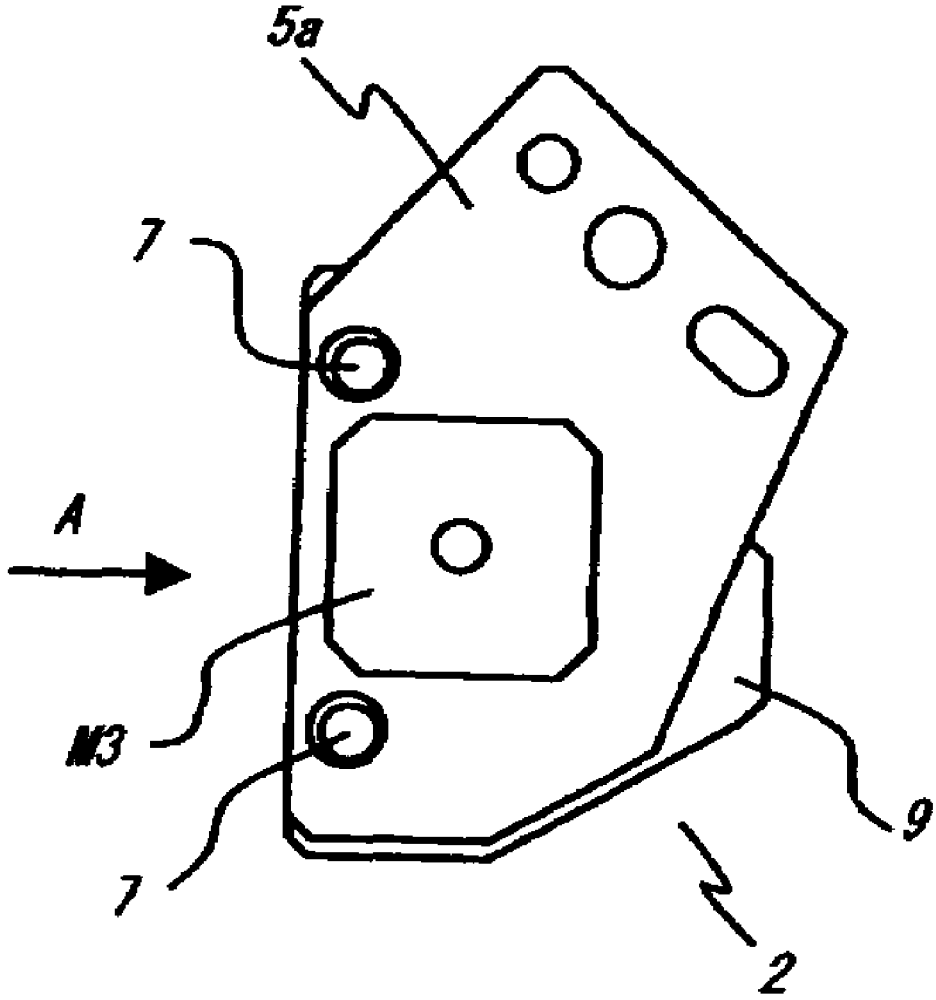
FIGS. 3A and 3B are schematic diagrams of the configuration of a transfer-side regulating device according to the embodiment of the present invention.
Figure 3B:
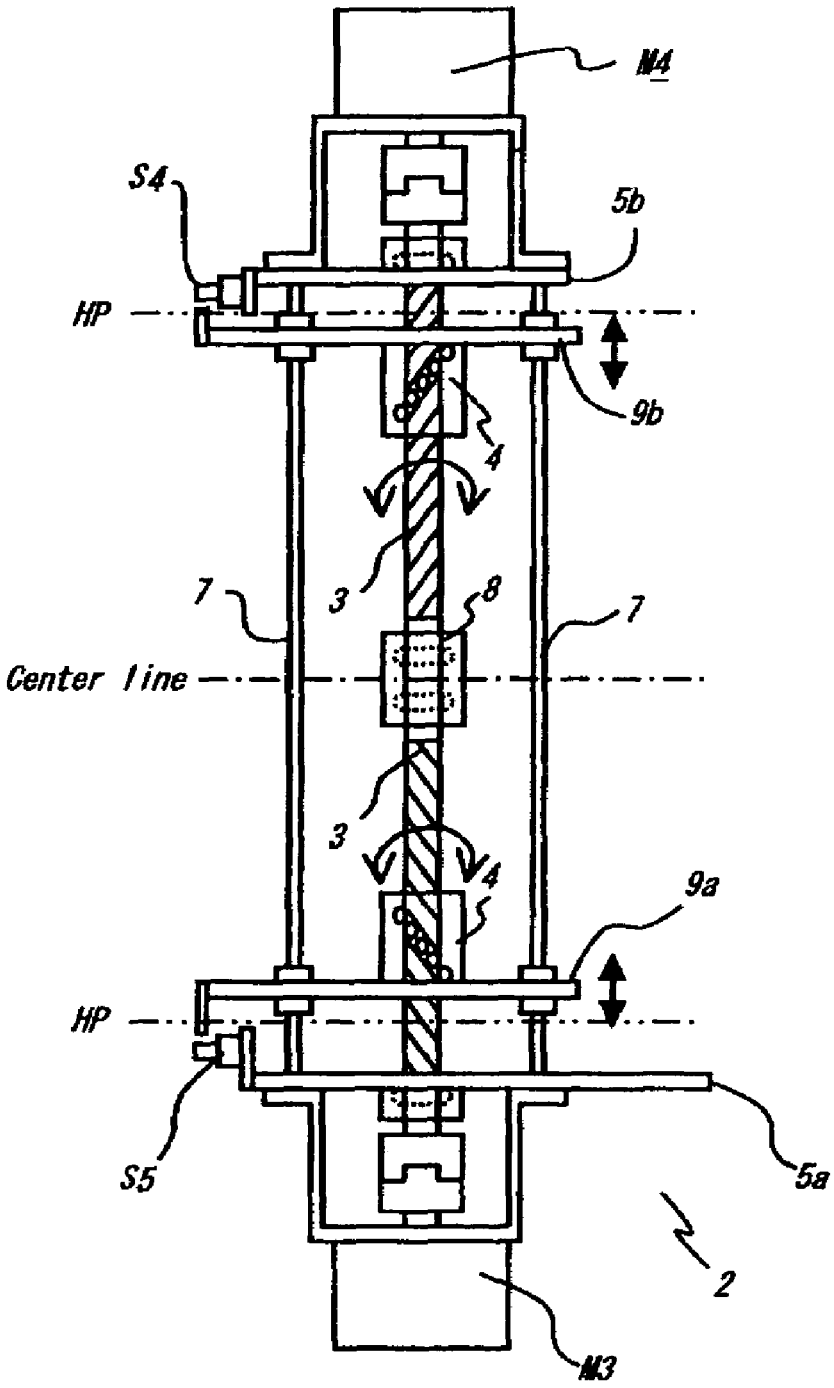

As described above, the sheet is conveyed to the secondary transfer portion such that a sheet center (the center of a sheet in the sheet width direction) and a conveyance center are aligned to each other by the sheet registration device 30. In this case, the toner images are transferred. At this time, a transfer-side regulating device 2 serving as a sheet width direction regulating device to regulate a width direction of the sheet such that the sheet is fed without being skewed is arranged even though the outer diameter of the secondary transfer out-roller 44 is not uniformed. The transfer-side regulating device 2 is arranged near the secondary transfer out-roller 44 on the downstream side in the sheet conveyance direction (to be referred to as a "downstream side" hereinafter) (see FIG. 1). The transfer-side regulating device 2, as shown in FIG. 3, has two ball screws 3, nuts 4, and pulse motors M3 and M4 which are coaxially arranged back and forth, is integrated with a front-side plate 5*a* and a rear-side plate 5*b*, and is supported by two slide shafts 7. The ball screws 3 are connected by a bearing 8 at the center of the ball screws 3 and are designed to prevent forward and backward rotating forces from acting on the ball screws 3.

Side regulating plates 9 (side regulating plate (front) 9*a* and side regulating plate (rear) 9*b*) with which a side end of a sheet to be conveyed is brought into contact to regulate the position of the sheet are attached to the nuts 4, respectively. The side regulating plates 9 are designed to obtain moving force in the slide shaft direction from rotating force by the two slide shafts 7. At this time, a pitch of the ball screws is given by S (mm), and the numbers of pulses per rotation of the side regulating drive motors M3 and M4 constituted by the pulse motors are given by N. In this case, the number of drive pulses n of the side regulating drive motors when the side regulating plates 9 are moved by 1 (mm) are given by $n=N\times(1/S)$.

Home position sensors S4 and S5 which detect home positions HP of the side regulating plates 9 are arranged on the front-side plate 5*a* and the rear-side plate 5*b*, respectively. The home positions of the side regulating plates are arranged to be symmetrical positions at predetermined intervals with reference to the conveyance center. Therefore, the moving positions of the side regulating plates 9 are controlled based on the numbers of pulses and the rotating directions of the side regulating drive motors M3 and M4 by using the home positions as start points. The transfer-side regulating device 2 according to the embodiment is unitized. The transfer-side regulating device 2 is attached to the image forming apparatus system such that the transfer-side regulating device 2 is fitted on the front- and rear-side plates of an intermediate transfer belt device with pins and coupled to the system by a fastening member.

(Drive Control Unit of Transfer-Side Regulating Device)

Figure 4:
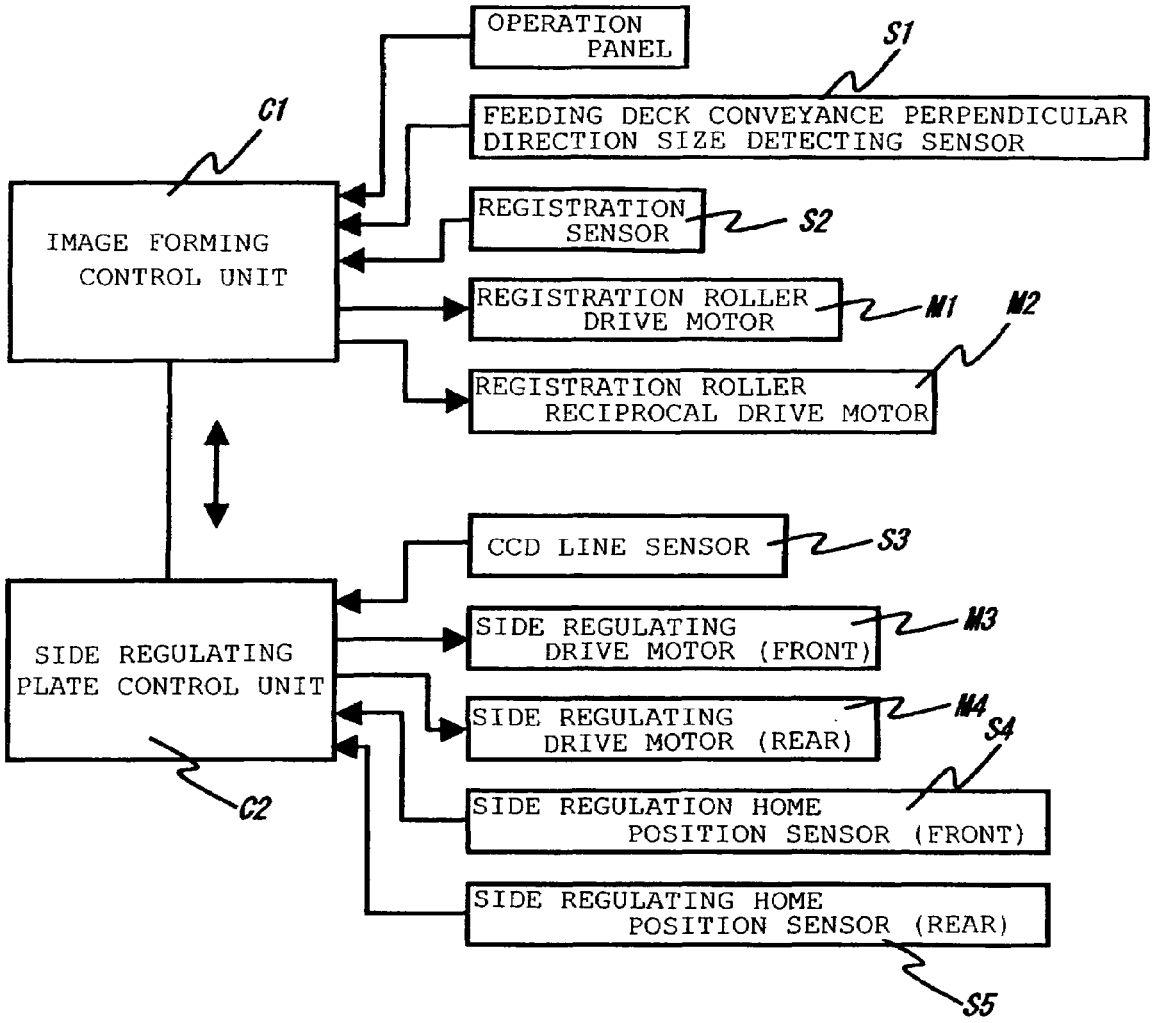
FIG. 4 is a diagram of the configuration of a control system related to the transfer-side regulating device according to the embodiment of the present invention.

The control unit which controls an operation of the transfer-side regulating device 2 is constructed as shown in FIG. 4. More specifically, a control unit of the image forming apparatus is constituted by an image forming control unit C1 which controls image formation and a side regulating plate control unit C2 serving as one of satellite control functions. In the image forming control unit C1, load elements are controlled based on a sensor input related to image formation. In particular, in the embodiment, an operation input from an operation panel (not shown) and signals from the conveyance perpendicular direction size detecting sensor S1 and the registration sensor S2 in the feeding deck are input to drive and control the motors such as the registration roller drive motor M1 and the registration roller reciprocal drive motor M2.

In the side regulating plate control unit C2, a signal from the CCD line sensor S3 in the registration device 30 and signals from the home position sensors S4 and S5 are input to drive and control the side regulating drive motors M3 and M4. The signals can be exchanged between the image forming control unit C1 and the side regulating plate control unit C2.

Figure 5:
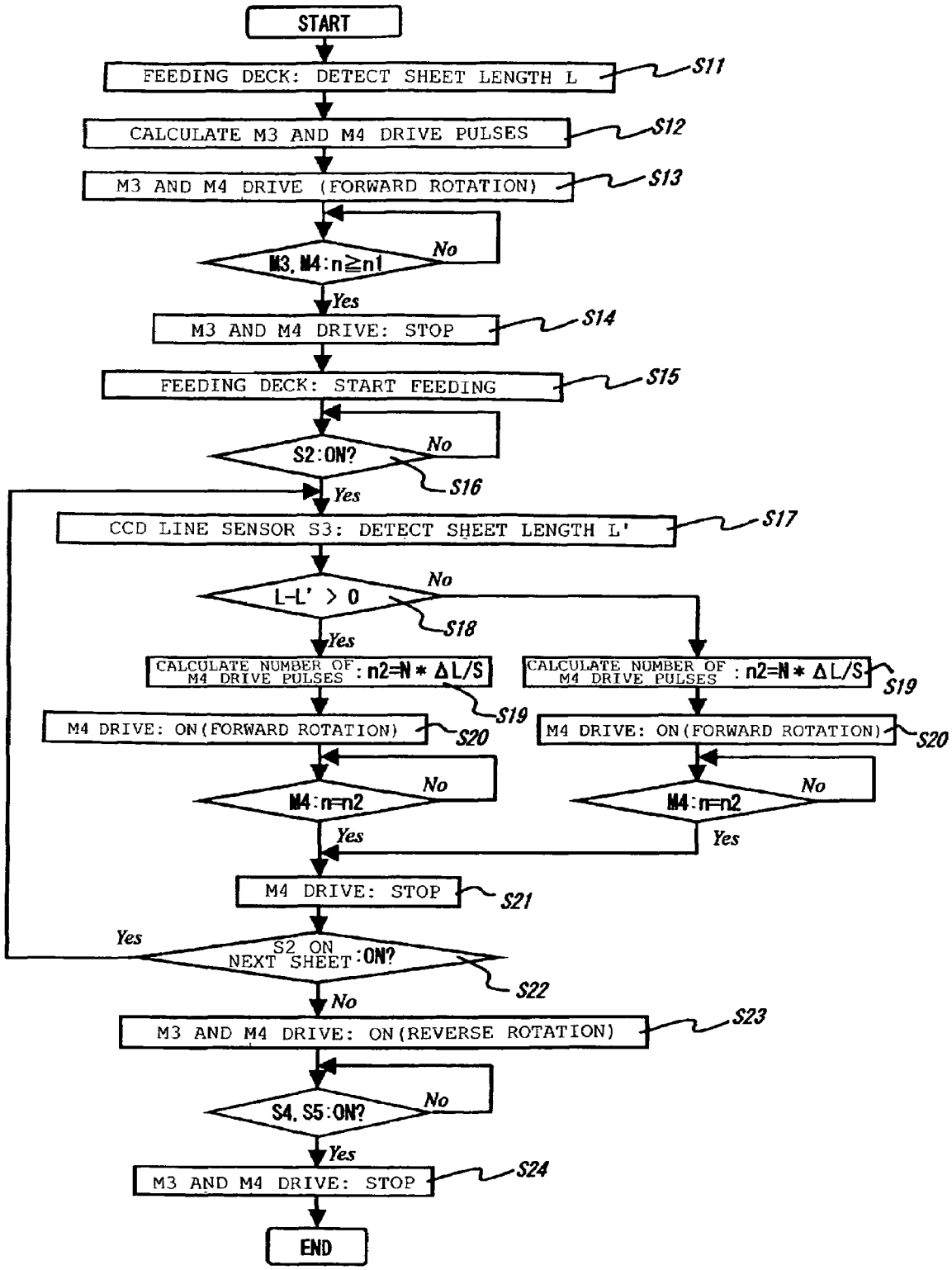
FIG. 5 is a flow chart of a positioning operation of transfer-side regulation according to the embodiment of the present invention.
Figure 6A:
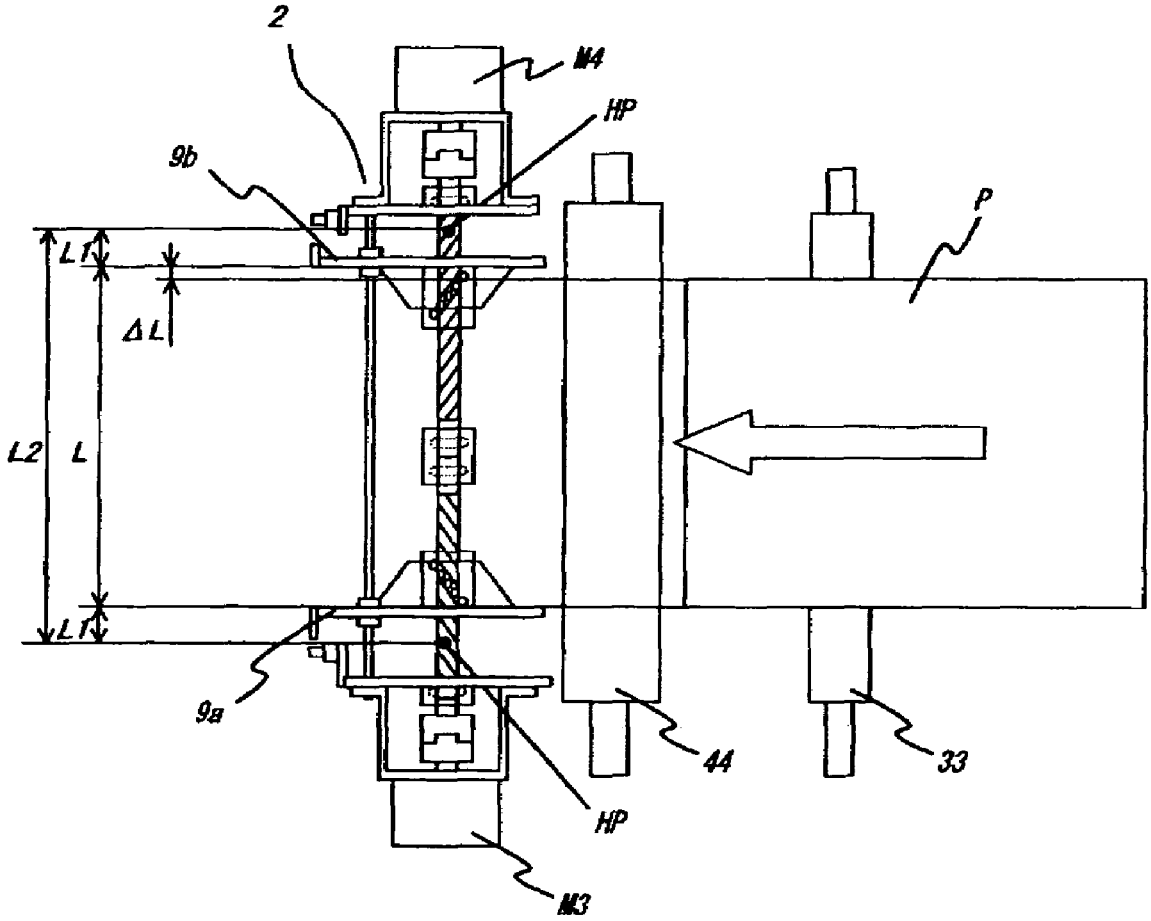
FIGS. 6A and 6B are schematic diagrams showing a positional relationship between a side regulating plate and a sheet subjected to sheet alignment correction by the registration device in the embodiment of the present invention.
Figure 6B:
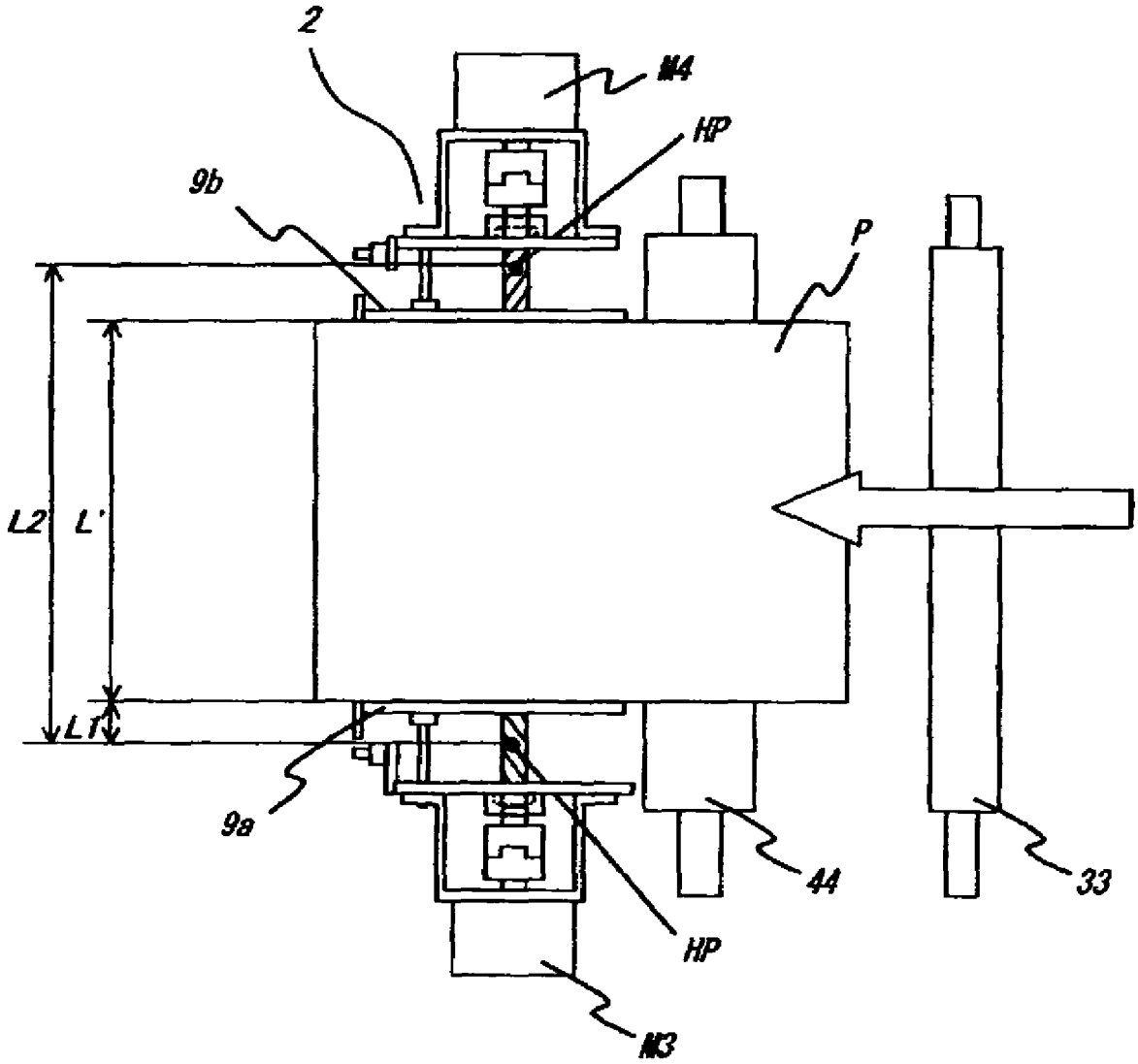

In this case, an operation sequence related to a side regulating plate positioning operation performed by the control unit will be described below. FIG. 5 is a schematic diagram showing a flow chart of the side regulating plate positioning operation, and FIG. 6 is a schematic diagram showing a positional relationship between the side regulating plate and a sheet P.

A user sets the image forming apparatus. In this case, since positioning is performed by a threshold plate which regulates the width direction of a sheet stack supported on the feeding deck 10, the conveyance perpendicular direction size detecting sensor S1 detects a length L (mm) of the sheet stack in the sheet width direction (S11). However, in this case, the value is obtained as a size standard value L (mm) of the sheet at the control unit. A user inputs a sheet size on an operation panel (not shown) to make it possible to obtain the length of a sheet L in the width direction.

First, the numbers of drive pulses n1 of the side regulating drive motors M3 and M4 corresponding to a distance L1 by which the side regulating plates 9*a* and 9*b* are moved from the home position are calculated from the length L of the sheet stack in the sheet width direction obtained by the feeding deck 10 (S12). At this time, when a home position interval between the front- and rear-side regulating plates is given by L2, an amount of movement L1 is given as (L2−L)/2. Therefore, the numbers of drive pulses n1 of the side regulating drive motors M3 and M4 are given by $n1=N\times\{(L2-L)/2\}/S$.

The side regulating drive motors M3 and M4 are driven (S13). When the numbers of motor pulses n reach the predetermined number of pulses n1, the side regulating drive motors M3 and M4 are stopped and wait at the positions (S14).

The sheet P is fed from the feeding deck 10 (S15) and conveyed to registration device 30, and the distal end of the sheet is detected by the registration sensor S2 (S16). In this case, as described above, the sheet P conveyed by the registration device 30 is brought into contact with the sheet correcting plate 31 by the skew feed roller 32. In this state, an end position of the back-side end of the sheet is read by the CCD line sensor S3. In this manner, an accurate length L' in the width direction of the sheet conveyed by the transfer portion is detected (S17) (see FIG. 2).

At this time the registration roller pair 33 conveys the sheet by drive of the registration roller drive motor M1. An amount of reciprocation in a reciprocating operation varies depending on sheets, and the reciprocating operation is performed by the registration roller reciprocal drive motorM2 to a position where the side regulating plate (front) 9*a* and the front end of the sheet are aligned. In this case, when the length of the sheet in the width direction is equal to the length L' actually detected, the reciprocating operation of the registration roller pair 33 is performed to align the sheet to the interval between the side regulating plate (front) 9*a* and the side regulating plate (rear) 9*b*. However, in general, since the sheet length L' varies depending on sheets, fine adjustment of the sheet length L' and the side regulating plate interval L is performed.

The fine adjustment is performed by adjusting the position of the side regulating plate (rear) 9*b*. Therefore, the side regulating plate interval L obtained by the conveyance perpendicular direction size detecting sensor S1 of the feeding deck is compared with the sheet length L' read by the CCD line sensor S3. Based on the difference between the size standard value L and the actually detected length L', it is determined whether the pulse motor of the side regulating drive motor (rear) M4 is rotated forward (when L−L'>0) or backward (when L−L'<0) (S18). When an actual amount of adjustment is given by $\Delta L=|L-L'|$, the number of fine adjustment drive pulses n2 of the side regulating drive motors M4 is obtained by calculating $n2=N\times(\Delta L/S)$ (S19).

The side regulating drive motor (rear) M4 is rotated forward or backward by the calculated number of fine adjustment pulses n2 (S20) to adjust the position of the side regulating plate (rear) 9*b* (S21). In this manner, the interval between both the side regulating plates 9*a* and 9*b* is equal to the length of the sheet in the width direction.

The fine adjustment operation is performed before the distal end of the sheet reaches the transfer roller. At this time, a nip releasing operation of the registration roller pair 33 is performed after the sheet P is conveyed to a position where side regulation is performed by the side regulating plates 9, and a reciprocating operation is performed.

Subsequently, the side regulating plate (rear) 9*b* is finely adjusted. When the sheet P is transferred, it is determined by the registration sensor S2 whether the next sheet is present or not (S22). In this case, it is determined that the next sheet is present, the same sequence is repeated. When the next sheet is absent, the side regulating drive motors M3 and M4 are reversely rotated (S23) to retreat the side regulating plates 9*a* and 9*b* to a position detected by the side regulating home position sensors S4 and S5, thereby ending the operation (S24).

In the embodiment, control for determining whether a side regulating operation is necessary or not is also performed depending on a type of a sheet. More specifically, when a type of a sheet in use is input by a user through an operation panel (not shown), or when a sheet type is detected by a material detecting device which detects a sheet type (not shown), the determination is performed. In this case, based on the rigidity of the sheet (for example, information of a thickness), it is determined whether the control operation is performed or not. For example, when the rigidity of the sheet is poor, the rigidity of the sheet is poor when skew feeding force (in this case, force of the sheet in the width direction) is generated on the transfer portion, and the sheet is brought into contact with the side regulating plates 9 and then curved, or the sheet may be bent or damaged. Therefore, a side regulating operation is performed to a sheet having predetermined sheet rigidity or higher.

The sheet on which an image is formed is regulated by the side regulating plates 9 to release the nip of the registration roller pair 33 in image formation. In this manner, even though the sheet is conveyed by only the secondary transfer out-roller 44, the side end of the sheet in the sheet width is brought into contact with the side regulating plates 9 and regulated, the rotating operation of the sheet P to be conveyed is restricted to convey the sheet P in only the conveyance direction. For this reason, the sheet P is conveyed without being skewed. Thereby accurate alignment between the sheet P and a toner image is secured to make it possible to obtain preferable image position accuracy, and a high-quality image can be obtained.

When a toner image is transferred onto a sheet, the image ratio of the toner image is extremely deviated from the sheet width direction. The sheet is not skewed by deviation of a friction coefficient between the intermediate transfer belt 40 and the sheet P to make it possible to obtain preferable image position accuracy.

Furthermore, even in a sheet position correcting device constituted by the skew feed roller 32, the sheet correcting plate 31, and the registration roller pair 33 which can perform a reciprocating operation, releasing of the nip of the registration roller pair 33 and a reciprocating operation to a standby position can be performed before the rear end of the sheet passes through the registration roller pair 33. In this manner, a conveyance interval between sheets can be shortened, and productivity in the image forming apparatus can be easily improved.

In addition, side regulation of a sheet can be accurately performed by the transfer portion depending on variations in size of sheets, preferable image position accuracy which is free from skew feeding can be obtained.

ANOTHER EMBODIMENT

Figure 7:
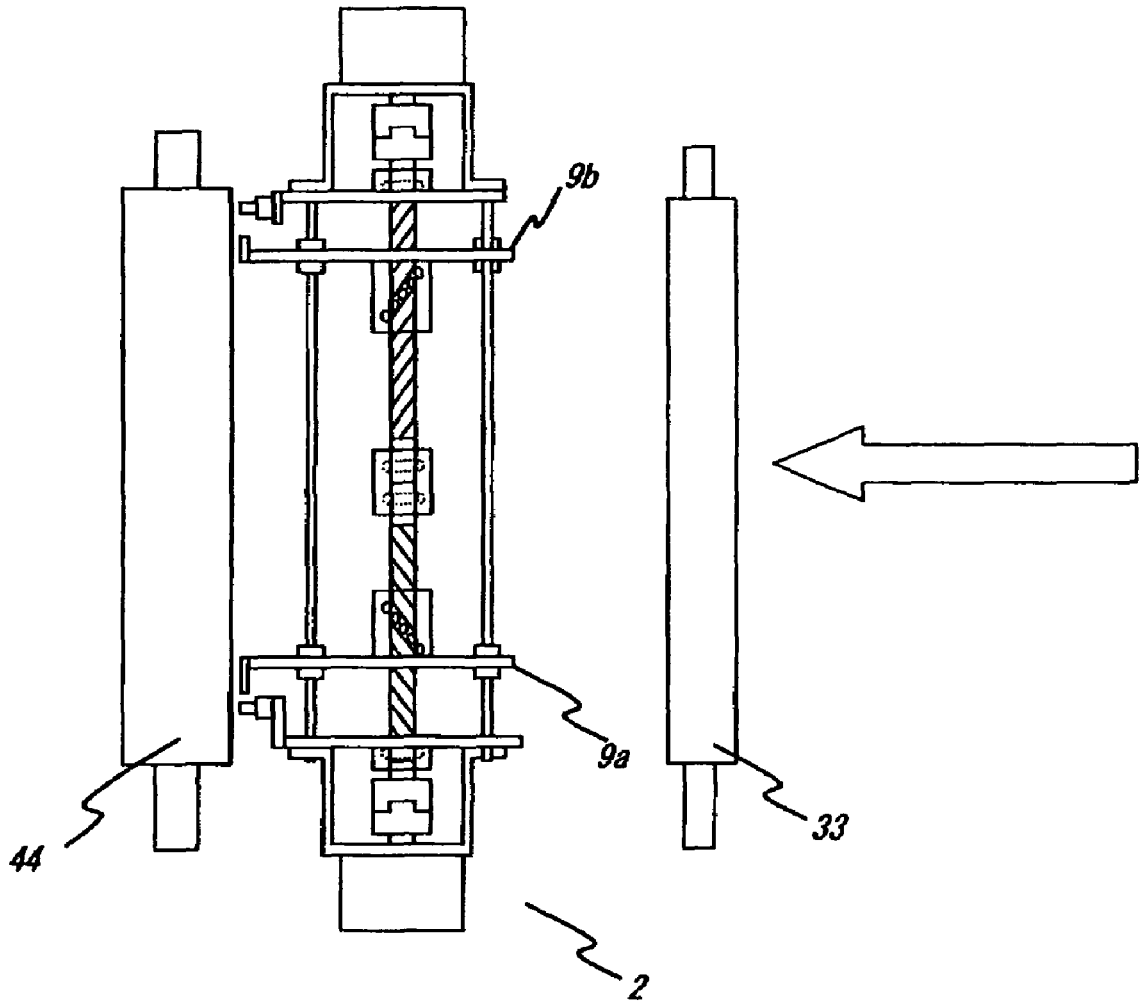
FIG. 7 is a diagram for explaining an embodiment in which a transfer-side regulating device is arranged on an upstream side of a transfer out-roller.
Figure 8:
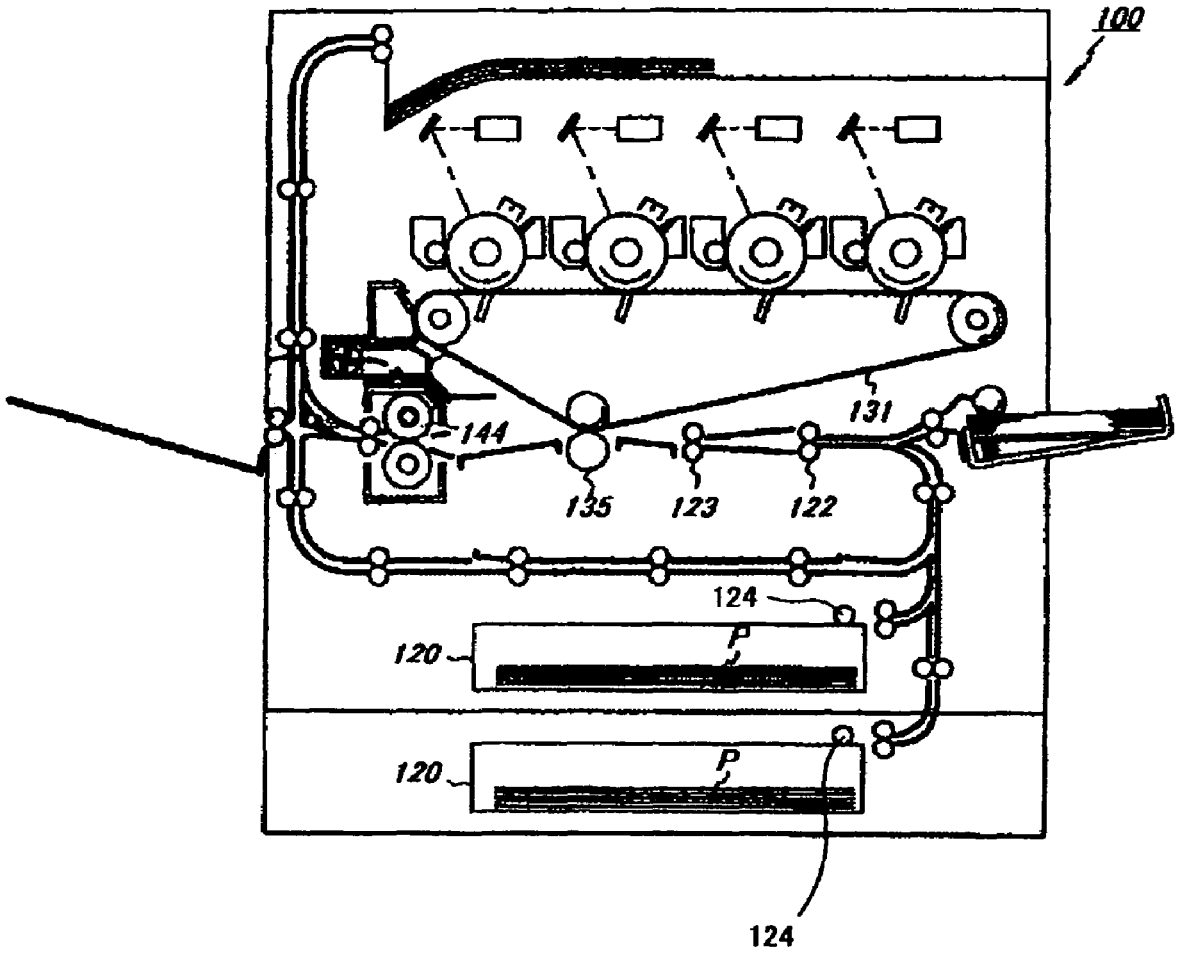
FIG. 8 is a sectional view of a conventional image forming apparatus.
Figure 9A:
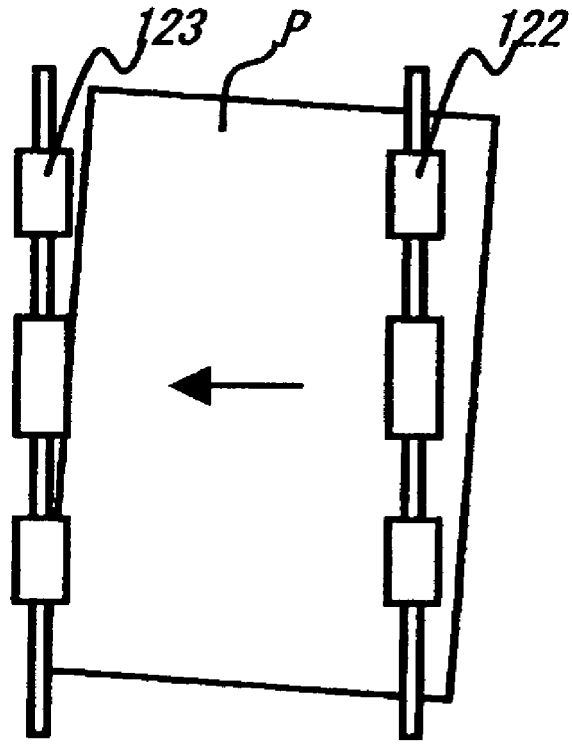
FIGS. 9A and 9B are diagrams for explaining sheet alignment correction performed by a conventional registration roller pair.
Figure 9A:
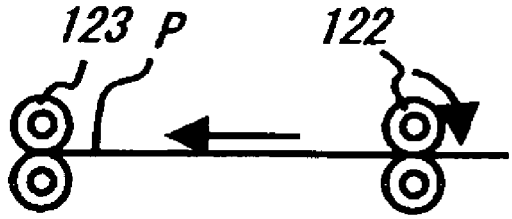
Figure 9B:
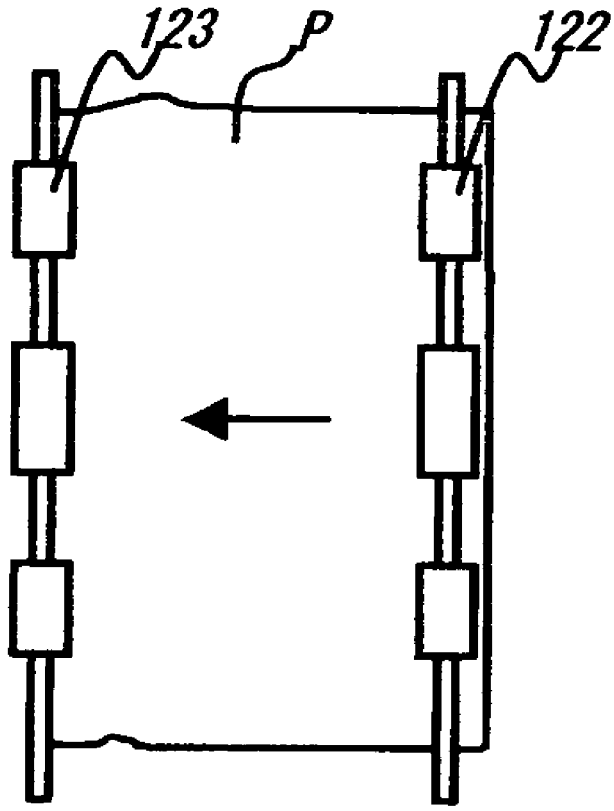
Figure 9B:
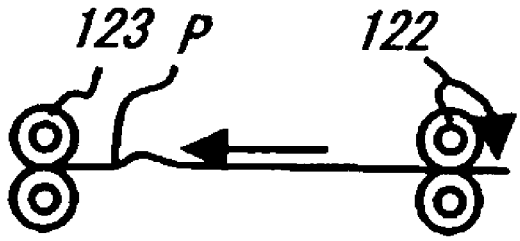
Figure 10A:
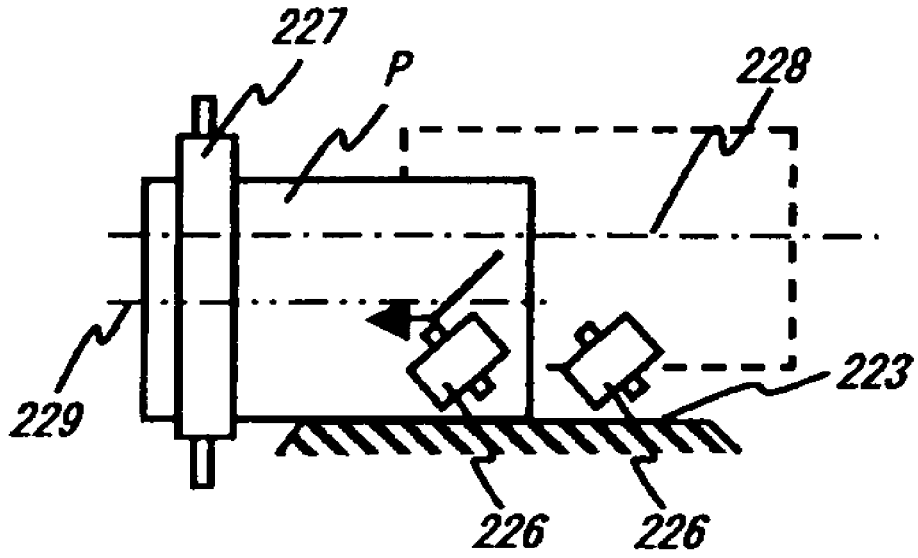
FIGS. 10A to 10D are diagrams for explaining sheet alignment correction near a conventional skew feed roller.
Figure 10A:
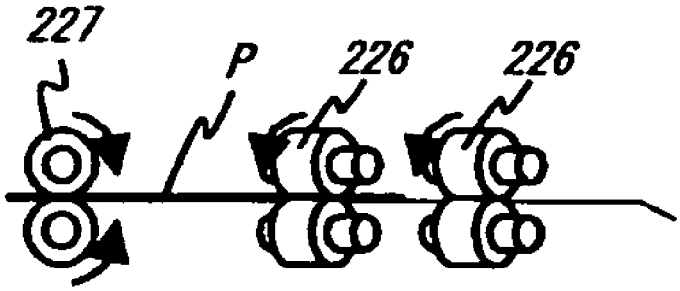
Figure 10B:
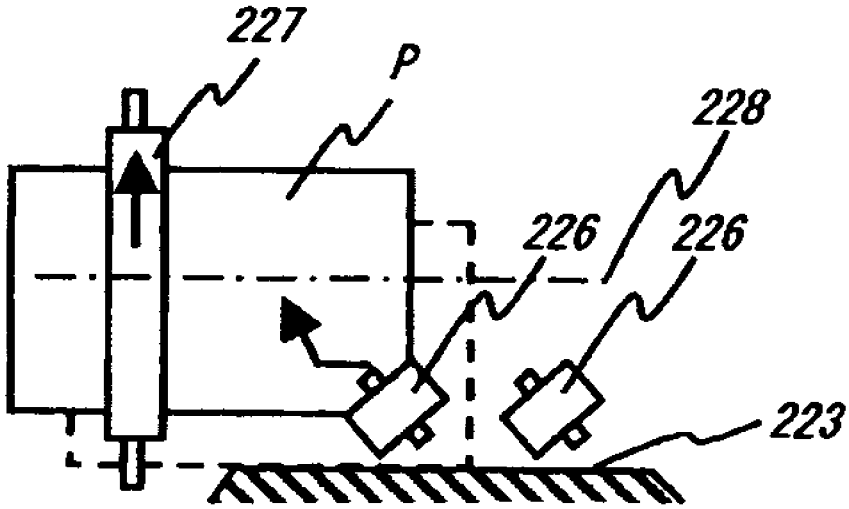
Figure 10B:
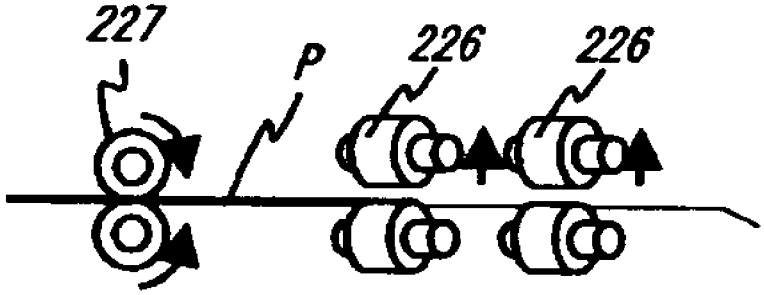
Figure 10C:
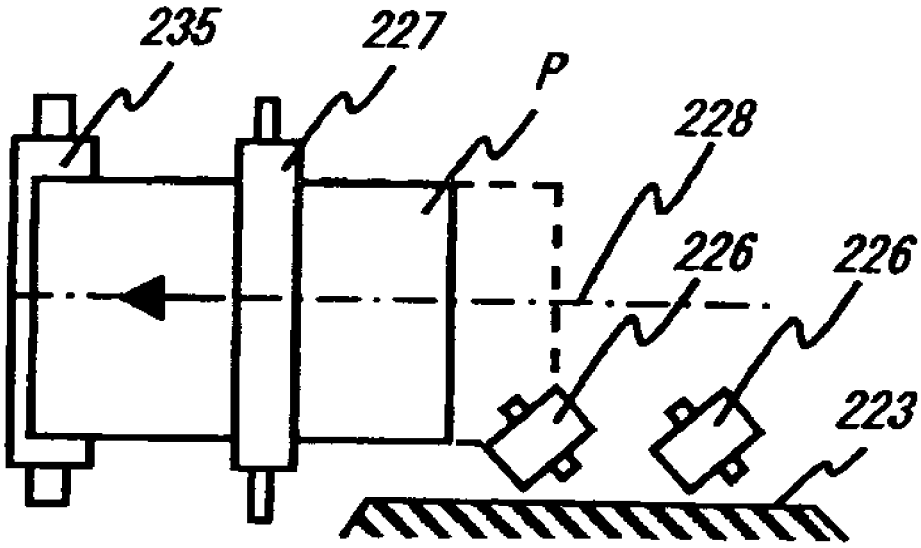
Figure 10C:
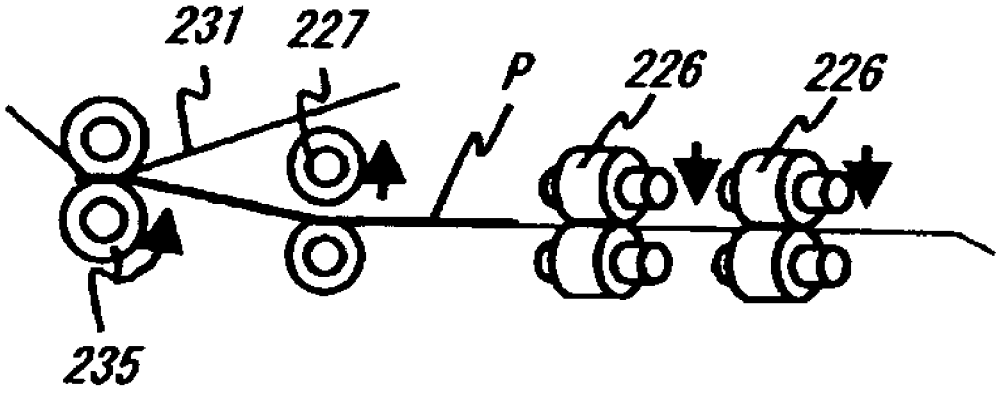
Figure 10D:
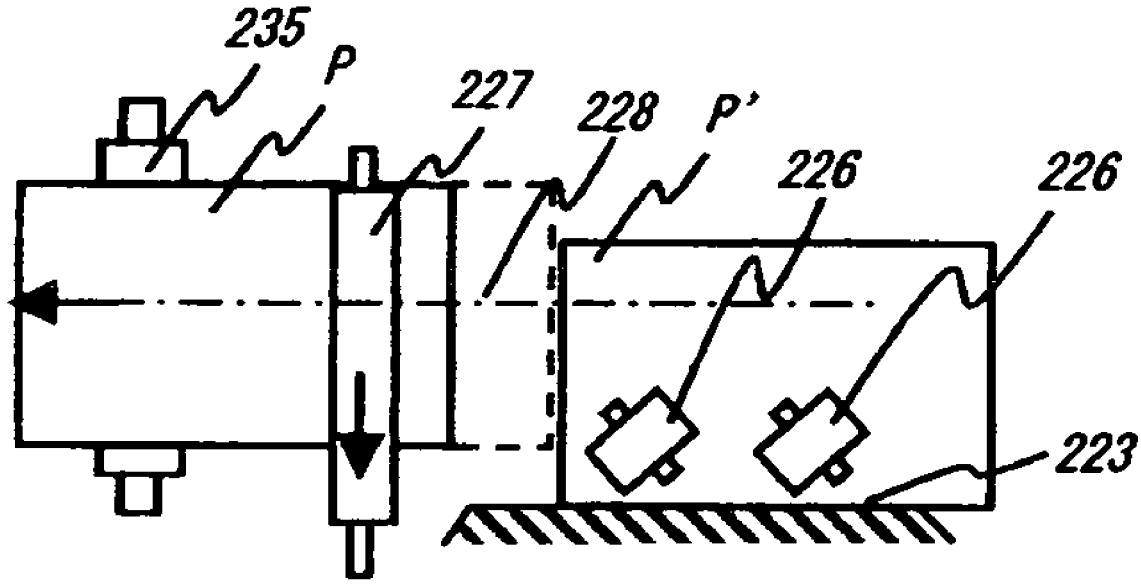
Figure 10D:
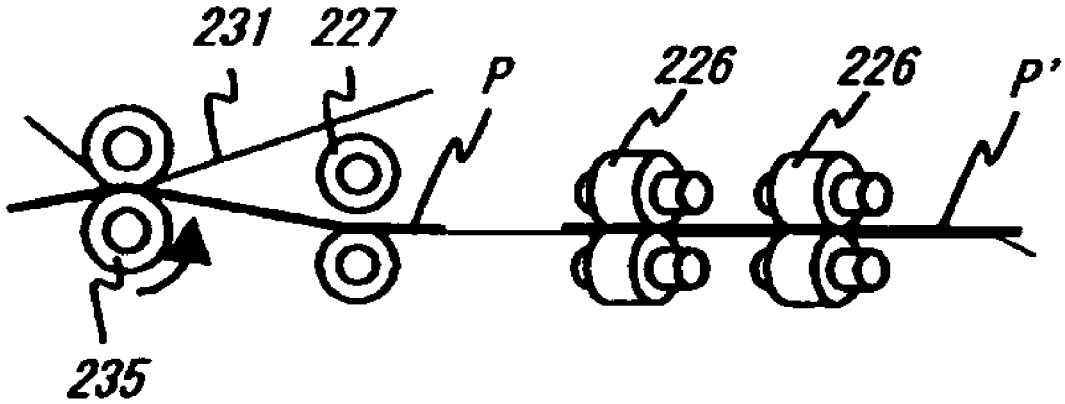

In the above embodiment, the transfer-side regulating device 2 serving as a sheet width direction regulating device is arranged near the secondary transfer out-roller 44 on the downstream side thereof. However, as shown in FIG. 7, even though a transfer-side regulating device 2 having the same configuration as that of the transfer side regulating device is arranged near the secondary transfer out-roller 44 on the downstream side thereof, the same effect as that in the embodiment can be obtained.

In the above embodiment, the CCD line sensor S3 detects the position of the other side end of a sheet, one side end of which is brought into contact with the sheet correcting plate 31, to detect the width of a conveyed sheet, thereby controlling an interval of the side regulating plates 9.

However when the sheet stack is supported on the feeding deck 10, a sheet width detecting device detects a sheet width by detecting an interval between threshold plates regulated both ends thereof in the sheet stack width direction and may be configured to control the interval between the side regulating plates 9 based on the detection result. In this manner, although size adjustment of the sheets is not performed every sheet, an image forming rate can be increased because the side regulating plates 9 are easily performed.

Even in a configuration except for the configuration which detects the width of a sheet stack supported on the feeding deck 10, a sheet width is detected based on sheet size information input from the operation panel. On the basis of the result, the interval between the side regulating plates 9 may be controlled. In this manner, an effect which is almost the same as that obtained when a sheet size on the feeding deck 10 is detected can be obtained. In this case, the sheet detecting configuration can be further simplified.

This application claims the benefit of priority from the prior Japanese Patent Application No. 2005-022721 filed on Jan. 31, 2005 the entire contents of which are incorporated by reference herein.

What is claimed is:

1. An image forming apparatus which has image recording device to record an image to a sheet, comprising:

a sheet conveying device which conveys a sheet to the image recording device;

a sheet regulating device which has a pair of side regulating plates, and the side regulating plates are brought into contact by a driving device with both side ends of a sheet on which an image is formed by the image recording device and regulates a position of the sheet in a widthwise direction while the image is formed on the sheet; and a control unit which controls the driving device to move the side regulating plates to positions where the position of the sheet in the widthwise direction is regulated depending on the size of the sheet on which an image is to be formed.

2. The image forming apparatus according to claim 1, further comprising a sheet width detecting device to detect the size of a sheet in the sheet width direction perpendicular to a conveyance direction of the sheet by the sheet conveying device, and wherein the control unit controls the driving device to move the side regulating plates based on detection performed by the sheet width detecting device.

3. The image forming apparatus according to claim 1, wherein the image recording device has an image bearing member which bears a toner image and a transfer roller which brings a sheet into contact with the image bearing member and conveys the sheet, and the sheet regulating device is arranged on an upstream side or a downstream side in a sheet conveyance direction.

4. The image forming apparatus according to claim 1, wherein a registration device which corrects the position of a sheet to be conveyed is arranged on the upstream side of the image recording device in a sheet conveyance direction, the registration device has a sheet correcting plate and a skew feed roller to bring the sheet into contact with the sheet correcting plate in order to correct skew feeding of the sheet, a registration roller pair which can be reciprocated is arranged to correct the position of the sheet, and the sheet is moved by the reciprocating operation of the registration roller pair such that the sheet is aligned to a regulated position of the sheet width direction regulating device.

5. The image forming apparatus according to claim 4, wherein a nip of the registration roller pair is released by a nip releasing device when the sheet conveyed by the image recording device is regulated by the sheet regulating device.

6. The image forming apparatus according to claim 2, wherein the pair of side regulating plates can be separated from each other and contacted to each other, the control unit sets an interval between the side regulating plates based on a size standard value of a conveyed sheet in the width direction, and, depending on information obtained by detecting an actual size of the conveyed sheet in the width direction by the sheet width detecting device, the size regulating plates are moved by a difference between the size standard value and the actual size.

7. The image forming apparatus according to claim 2, wherein the sheet width detecting device detects a position of the side end of a sheet conveyed by the sheet conveying device in the width direction to detect a size in the sheet width direction.

8. The image forming apparatus according to claim 2, wherein the sheet width detecting device detects the size of a sheet in the sheet width direction, the sheet being supported on a sheet stacking portion to supported a sheet on which an image is to be formed.

9. The image forming apparatus according to claim 2, wherein the sheet width detecting device detects the size in the sheet width direction based on information input from an operation panel.

10. The image forming apparatus according to claim 2, wherein the control unit determines whether a regulating operation in a sheet width direction is performed by the sheet regulating device based on information of sheet rigidity, and the control unit causes the sheet regulating device to perform a regulating operation to a sheet having sheet rigidity which is not less than predetermined sheet rigidity.

* * * * *